US006489878B2

(12) United States Patent
Baarman et al.

(10) Patent No.: US 6,489,878 B2
(45) Date of Patent: Dec. 3, 2002

(54) METHOD OF MANUFACTURING A MAGNETIC POWER COMPONENT AND A MAGNETIC POWER COMPONENT

(75) Inventors: Gösta Baarman, Siuntio (FI); Björn Holmström, legally incapacitated, Espoo (FI); by Ursula Holmström, legal representative, Esbo (FI); Markku Jämsä, Veikkola (FI); Seppo Pelkonen, Vantaa (FI)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/984,447

(22) Filed: Oct. 30, 2001

(65) Prior Publication Data

US 2002/0057585 A1 May 16, 2002

Related U.S. Application Data

(63) Continuation of application No. PCT/FI00/00414, filed on May 9, 2000.

(30) Foreign Application Priority Data

May 11, 1999 (FI) ..... 991084

(51) Int. Cl.[7] ..... H01F 5/00

(52) U.S. Cl. ..... 336/200; 336/223; 336/232; 29/602.1

(58) Field of Search ..... 336/200, 223, 336/232; 29/602.1, 606

(56) References Cited

U.S. PATENT DOCUMENTS

| | | | | | |
|---|---|---|---|---|---|
| 4,873,757 | A | * | 10/1989 | Williams | 29/602.1 |
| 6,000,128 | A | * | 12/1999 | Umeno et al. | 29/846 |
| 6,073,339 | A | * | 6/2000 | Levin | 29/606 |
| 6,211,767 | B1 | * | 4/2001 | Jitaru | 336/200 |
| 6,262,649 | B1 | * | 7/2001 | Roessler et al. | 336/65 |
| 6,281,779 | B1 | * | 8/2001 | Matsumoto et al. | 336/200 |

FOREIGN PATENT DOCUMENTS

| | | |
|---|---|---|
| EP | 741 396 | 11/1996 |
| JP | 3181191 | 8/1991 |
| JP | 9213525 | 8/1997 |

* cited by examiner

*Primary Examiner*—Anh Mai
(74) *Attorney, Agent, or Firm*—Pillsbury Winthrop LLP

(57) ABSTRACT

The invention relates to a method of manufacturing a magnetic power component and to a magnetic power component. The component comprises a multi-layer coil (1) which consists of several windings disposed in the layers, first and second electrical conductors (5, 6) which are electrically connected to the selected windings, and a first and a second core part (7, 8) which are arranged to direct magnetism to the windings. The first side (2) of the multi-layer coil (1) is provided with a cavity (9) and the first core part (7) is at least partially mounted in the cavity.

11 Claims, 1 Drawing Sheet

METHOD OF MANUFACTURING A MAGNETIC POWER COMPONENT AND A MAGNETIC POWER COMPONENT

This application is a Continuation of International Application PCT/FI00/00414 filed May 9, 2000 which designated the U.S. and was published under PCT Article 21(2) in English.

BACKGROUND OF THE INVENTION

The invention relates to a method of manufacturing a magnetic power component according to the preamble of claim 1.

The invention also relates to a magnetic power component according to the preamble of claim 3.

Magnetic power components where the core consists of a first core part which is on the first side of a multi-layer coil and of a second core part which is on the second side of the multi-layer coil require connecting feet because the coil of the magnetic component will be placed at a distance from the circuit board. The purpose of the connecting feet is to connect the coil of the magnetic power component and the conductors of the circuit board electrically so that electric current can be supplied from the conductors of the circuit board to the coil and vice versa.

Attachment of the above-mentioned connecting feet to the coil is expensive.

One solution to avoiding the connecting feet is to arrange the winding of the magnetic power component evenly against the surface of the circuit board, in which case the first and the second conductors of the multi-layer coil could be connected electrically to the conductors of the circuit board directly without separate connecting feet.

A solution similar to this has been disclosed in European Application No. 0,741,396 A1, which teaches that the circuit board may comprise an aperture at the ferrite core. The aperture enables placing of the multi-layer coil near the circuit board and thus separate connecting feet are not necessary.

However, such an aperture in the circuit board decreases the useful surface area of the circuit board and thus makes the design and manufacture of circuit boards more difficult.

BRIEF DESCRIPTION OF THE INVENTION

The object of the invention is to provide a method of manufacturing a magnetic power component and a magnetic power component which eliminate the above-mentioned problems.

The objects of the invention are achieved by a method and an arrangement which are characterized by what is stated in the independent claims.

Dependent claim 2 discloses a preferred embodiment of the above-mentioned method.

Dependent claims 4 to 9 disclose preferred embodiments of the magnetic power component according to the invention.

An advantage of the solution of the invention is that it simplifies the magnetic power component. The power component does not require separate connecting feet since the multi-layer coil of the magnetic power component can be placed against the circuit board and fused directly with the conductors of the circuit board without connecting feet.

Since no aperture is necessary in the circuit board at the ferrite core, the solution of the invention simplifies the manufacture and design of the circuit board and increases its useful surface area.

BRIEF DESCRIPTION OF THE DRAWINGS

The invention will be described in greater detail by means of preferred embodiments, with reference to the attached drawings, in which.

DETAILED DESCRIPTION OF THE INVENTION

Figure 1:
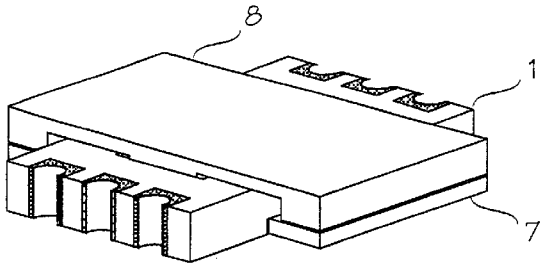
FIG. 1 shows a magnetic power component.
Figure 2:
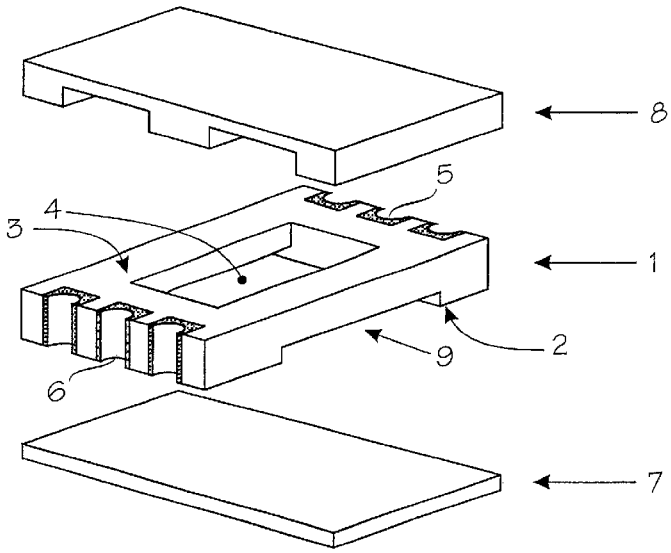
FIG. 2 shows a disassembled magnetic power component.

FIG. 1 shows a magnetic power component, which may be e.g. a transformer. FIG. 2 is a disassembled view of the magnetic power component of FIG. 1.

The magnetic power component comprises a multi-layer coil 1, which consists of several windings (not shown) disposed in the layers (not shown). The multi-layer coil 1 consists of a first side 2 and a second side 3. In FIG. 2 the multi-layer coil 1 also comprises an aperture 4.

FIG. 2 shows a multi-layer coil 1 the first side 2 and the second side 3 of which are substantially planar and substantially parallel with each other. In FIG. 2 there is also an aperture 4 substantially in the middle of the multi-layer coil 1.

The multi-layer coil 1 is preferably, but not necessarily, a 'circuit board coil'.

The thickness of the multi-layer coil 1 is preferably 3 to 7 mm, more preferably 4 to 6 mm and most preferably about 5 mm.

The magnetic power component also comprises first electrical conductors 5 and second electrical conductors 6 which are connected electrically to the selected windings. The first electrical conductors 5 and the second electrical conductors 6 are preferably such that they can be directly fused with the conductors of the circuit board 11. In FIG. 2 the first 5 and the second electrical conductors 6 are formed of first and second lateral cavities which are provided with a conducting material, e.g. copper.

If the magnetic power component is a transformer, the first 5 and the second electrical conductors 6 are electrically connected to the windings so that the transformer comprises at least one primary coil (not shown) and at least one secondary coil (not shown).

The magnetic power component also comprises a first core part 7 which is on the first side 2 of the multi-layer coil 1 and a second core part 8 which is on the second side 3 of the multi-layer coil 1.

The first core part 7 and the second core part 8 preferably touch each other. Preferably they are also connected to each other.

The first core part 7 and/or the second core part 8 are/is preferably, but not necessarily, mounted at least partially in the aperture 4 of the multi-layer coil 1.

The first core part 7 and the second core part 8 are preferably made of ferromagnetic material. Alternatively, the first core part 7 and the second core part 8 may be made of some other material with magnetic properties.

The first core part 7 and the second core part 8 touch each other. The first core part 7 and the second core part 8 are arranged to direct magnetism to the windings.

There is a cavity 9 on the first side 2 of the multi-layer coil 1.

The cavity 9 may be formed by removing material from the multi-layer coil 1.

Figure 3:
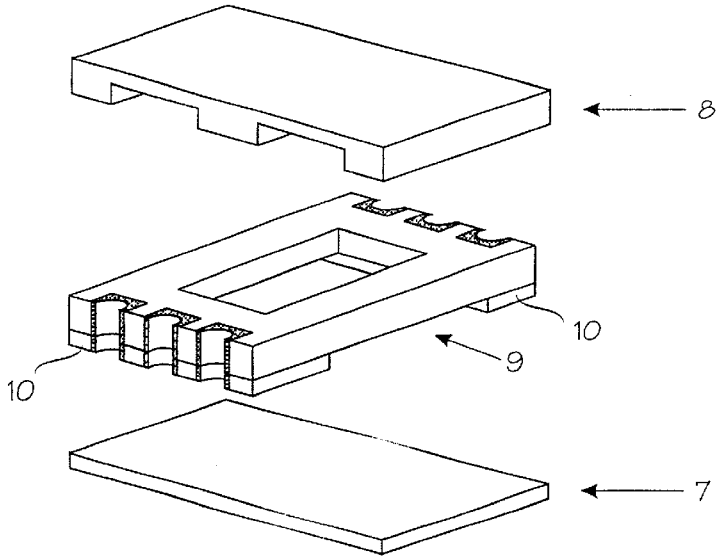
FIG. 3 shows a disassembled magnetic power component where a cavity is formed by means of base parts.

Alternatively the cavity 9 may be formed by attaching at least two base parts 10 to the multi-layer coil 1 to provide a cavity 9 between the base parts 10. FIG. 3 is a view of a partially disassembled magnetic power component which comprises two base parts 10. The number of base parts 10 may also differ from that.

Figure 4:
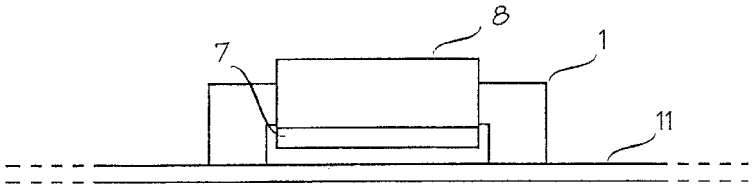
FIG. 4 shows a magnetic power component mounted on the circuit board.

The first core part 7 is mounted at least partially in the cavity 9 to allow placing of the magnetic power component on the circuit board 11 so that the first side 2 of the multi-layer coil 1 is against the circuit board 11 and the first core part 7 in the cavity 9 is at a distance from the circuit board 11 and the first electrical conductors 5 and the second electrical conductors 6 can be attached to the conductors (not shown) of the circuit board 11, which allows supply of current from the conductors of the circuit board 11 to the multi-layer coil 1 and vice versa. The cavity 9 should be dimensioned and designed to house the first core part 7 so that the above-mentioned requirements are fulfilled. FIG. 4 illustrates a magnetic power component which is placed on the circuit board 11.

FIG. 2 illustrates a magnetic power component where the first core part 7 is an I core part and the second core part 8 is an E core part.

The E core part comprises three projections and the middle projection is in the aperture 4 provided in the multi-layer coil.

Alternatively, the first core part 7 may be an E core part and the second core part 8 an I core part. Other shapes are also possible for the first core part 7 and the second core part 8. The magnetic power component may comprise two E core parts, for example.

The invention also relates to a method of manufacturing a magnetic power component.

The method comprises a step of manufacturing a multi-layer coil 1 comprising several windings disposed in the layers.

The multi-layer coil 1 is preferably provided with an aperture 4.

The multi-layer coil is preferably, but not necessarily, manufactured applying a manufacturing technique used for circuit boards.

The method also comprises a step in which the first electrical conductors 5 and the second electrical conductors 6 are connected electrically to the selected windings.

If the magnetic power component is a transformer, the first electrical conductors 5 and the second electric conductors 6 are connected electrically to the windings to provide at least one primary coil and at least one secondary coil.

The method also includes a step of placing the first core part 7 on the first side of the multi-layer coil 1 and the second core part 8 on the second side 3 of the multi-layer coil 1 so that the first core part 7 and the second core part 8 touch each other.

The first core part 7 and the second core part 8 are arranged to magnetize the windings.

The method further comprises a step of removing material from the first side 2 of the multi-layer coil 1 to provide a cavity 9. Material is preferably removed by machining, e.g. by milling.

In addition, the method comprises a step of mounting the first core part 7 at least partially in the cavity 9 to allow placing of the magnetic power component on the circuit board 11 so that the first side 2 of the multi-layer coil 1 is against the circuit board 11 and the first core part 7 in the cavity 9 is at a distance from the circuit board 11 and the first electrical conductors 5 and the second electrical conductors 6 can be connected to the conductors of the circuit board 11.

Instead of the step of material removal the method may comprise a step of attaching at least two base parts 10 to the first side 2 of the multi-layer coil 1 to provide a cavity 9 between the base parts 10. FIG. 3 shows a magnetic power component provided with two base parts 10.

This alternative method further comprises a step of mounting the first core part 7 in the cavity 9 to allow placing of the magnetic power component on the circuit board 11 so that the base parts 10 are against the circuit board 11 and the first core part 7 in the cavity is at a distance from the circuit board 11 and the first electrical conductors 5 and the second electrical conductors 6 can be connected to the conductors of the circuit board 11.

It will be obvious to a person skilled in the art that, as the technology advances, the inventive concept can be implemented in a variety of ways. Consequently, the invention and its embodiments are not limited to the examples described above, but may vary within the scope of the claims.

What is claimed is:

1. A method of manufacturing a magnetic power component, the method comprising manufacturing a multi-layer coil which comprises several windings disposed in the layers, electrically connecting first electrical conductors and second electrical conductors to selected windings, and mounting a first core part on the first side of the multi-layer coil and a second core part on the second side of the multi-layer coil, the first core part and the second core part being arranged to direct magnetism to the windings, removing material from the first side of the multi-layer coil to provide a cavity, and mounting the first core part at least partially in the cavity to allow placing of the magnetic power component on a circuit board so that the first side of the multi-layer coil is against the circuit board and the first core part in the cavity is at a distance from the circuit board and that the first electrical conductors and the second electrical conductors can be connected to the conductors of the circuit board.

2. A method according to claim 1, wherein material is removed by machining.

3. A magnetic power component comprising a multi-layer coil which consists of several windings disposed in the layers and comprises a first side and a second side, first electrical conductors and second electrical conductors which are connected electrically to selected windings, a first core part mounted on the first side of the multi-layer coil, and a second core part mounted on the second side of the multi-layer coil, wherein the first core part and the second core part are arranged to direct magnetism to the windings, the first side of the multi-layer coil is provided with a cavity, and the first core part is at least partially mounted in the cavity to allow placing of the magnetic power component on the circuit board so that the first side of the multi-layer coil is against the circuit board and the first core part in the cavity is at a distance from the circuit board and so that the first electrical conductors and the second electrical conductors is connectable to the conductors of the circuit board.

4. A magnetic power component according to claim 3, wherein the first core part is an E core part.

5. A magnetic power component according to claim 3, wherein the first core part is an I core part.

6. A magnetic power component according to claim 3, wherein the multi-layer coil is provided with an aperture.

7. A magnetic power component according to claim 3, wherein the multi-layer coil is a circuit board coil.

8. A magnetic power component according to claim 3, wherein the thickness of the multi-layer coil is 3 to 7 mm.

9. A magnetic power component according to claim 3, wherein the windings form the primary coil and the secondary coil of the transformer.

10. A magnetic power component according to claim 3, wherein the thickness of the multi-layer coil is 4 to 6 mm.

11. A magnetic power component according to claim 3, wherein the thickness of the multi-layer coil is approximately 5 mm.

* * * * *